United States Patent [19]

Oram

[11] Patent Number: 4,581,689

[45] Date of Patent: Apr. 8, 1986

[54] LAMP

[75] Inventor: John A. Oram, Leighton Buzzard, England

[73] Assignee: J & D Oram Limited, Leighton Buzzard, England

[21] Appl. No.: 673,705

[22] PCT Filed: Mar. 29, 1984

[86] PCT No.: PCT/GB84/00107

§ 371 Date: Nov. 14, 1984

§ 102(e) Date: Nov. 14, 1984

[87] PCT Pub. No.: WO84/03931

PCT Pub. Date: Oct. 11, 1984

[30] Foreign Application Priority Data

Mar. 29, 1983 [GB] United Kingdom ..... 8308693

[51] Int. Cl.[4] ..... F21V 21/30

[52] U.S. Cl. ..... 362/275; 362/287; 362/371; 362/401; 362/419; 362/432; 362/804

[58] Field of Search ..... 362/147, 275, 287, 401, 362/432, 804, 370, 371, 419

[56] References Cited

U.S. PATENT DOCUMENTS

| | | | |
|---|---|---|---|
| 1,598,606 | 9/1926 | Dey | 362/287 |
| 1,909,947 | 5/1933 | Greppin | 362/275 |
| 2,164,390 | 7/1939 | Dickerson | 362/432 |
| 2,215,635 | 9/1940 | Collins | 362/804 |
| 3,075,071 | 1/1963 | Lauterbach | 362/275 |
| 3,240,925 | 3/1966 | Paschke et al. | 362/275 |
| 4,165,530 | 8/1979 | Sowden | 362/401 |
| 4,316,237 | 2/1982 | Yamada et al. | 362/804 |
| 4,459,647 | 7/1984 | Yamauchi et al. | 362/804 |
| 4,463,413 | 7/1984 | Shirley | 362/275 |

FOREIGN PATENT DOCUMENTS

| | | | |
|---|---|---|---|
| 188476 | 3/1964 | Sweden | 362/401 |

*Primary Examiner*—Ira S. Lazarus

*Attorney, Agent, or Firm*—Sughrue, Mion, Zinn, Macpeak and Seas

[57] ABSTRACT

A lamp (5) is secured to the end (4) of a support arm for at least horizontal translational movement, and is pivotable about a vertical axis (10) for azimuth adjustment of the light beams (from lenses 82, 83). To facilitate such horizontal movement by means of a handle (15), the handle is disposed on or adjacent the vertical pivot axis (10). The lamp, which may also be pivotable by means of the handle (15) about a horizontal axis 11, is preferably located substantially entirely on one side of the vertical axis (11).

13 Claims, 7 Drawing Figures

LAMP

The present invention is concerned with lamps and lamp assemblies. Whilst these are of particular interest for medical and dental applications, they may of course be used in many other situations.

FIG. 1 shows a typical lamp assembly for a dental surgery. A support structure comprises an articulated two part arm on a mounting 1 (which may be secured to the ceiling), a pair of articulated arm sections 2, 3 and a bracket 4 supporting a lamp 5. The joints between these members are pivoted for rotation about axes 6 and 7 to permit horizontal translational movement of the bracket 4 in any direction, whilst the second arm 3 is pivoted about axes 8 and 9 and spring-balanced for vertical movement with a parallel ogram linkage (not shown) to maintain the bracket 4 in a vertical attitude. Thus the bracket and hence the lamp can be translated to any desired position. To permit azimuth adjustment of the lamp, the upper and lower ends of the bracket are pivotable relative to one another about a vertical axis 10. Thus this arm system permits freedom of spatial location together with azimuth movement of the light. This leave pitch movement of the light (about axis 11) to be provided within the light unit itself to complete the facility of universal spatial positioning combined with freedom to beam the light in any direction.

Conventionally the lamp 5 is fitted with handles 14, 15. In use, the dentist (if right handed) will sit or stand on his patient's right and adjust the position and angle of the lamp by means of the right-hand handle 15. If he is left-handed, he will generally sit or stand on the opposite side and use the other handle 14.

Although such arrangements have been found reasonably satisfactory, in practice they suffer from the disadvantage that, to effect movements along the line of arm 3, the user has to transmit the necessary forces to the support structure via the handle and lamp body and, in order to avoid the lamp simply rotating about its vertical pivot axis 10, must apply a compensating couple to the handle as well as the necessary directional force.

According to one aspect of the present invention there is provided a lamp assembly with a support structure permitting translational movement of a lamp portion at least in a generally horizontal plane, a lamp mounted to the support portion so as to be pivotable about a generally vertical axis for azimuth adjustment of a light beam or beams from the lamp, and a handle secured to the lamp, the handle being disposed on or adjacent to the vertical pivot axis.

In this way, the user is able to effect horizontal movement of the lamp without any substantial tendency for the lamp to rotate.

A convenient arrangement is to provide that the lamp is disposed substantially entirely on one side of the pivot axis: the handle may then be disposed on the other side of the axis.

Thus in another aspect, the invention provides an adjustable lamp comprising a housing rotatably attached to a bracket for rotation about a horizontal axis extending through the housing, a light source and beam forming means within the housing arranged to form a beam directed out of the housing transversely with respect to the said axis, and a handle attached to the housing for effecting the rotation thereof, the housing and the handle being located on opposite sides of the bracket.

Of course, this arrangement implies a handle on only one side of the lamp—at least, a handle on the other side will suffer excessively from the disadvantage discussed above. To permit adjustment from the opposite side, the lamp can be made pivotable about a generally horizontal axis (usually desirable in any event for pitch adjustment). Then, if a sufficient degree of rotation of the lamp about vertical and horizontal axes is allowed for, it can be rotated through 180° about both axes to assume on attitude which is a mirror-image of its former position, thereby permitting adjustment from the other side.

One embodiment of the invention will now be described, by way of example, with reference to the accompanying drawings.

Figure 1:
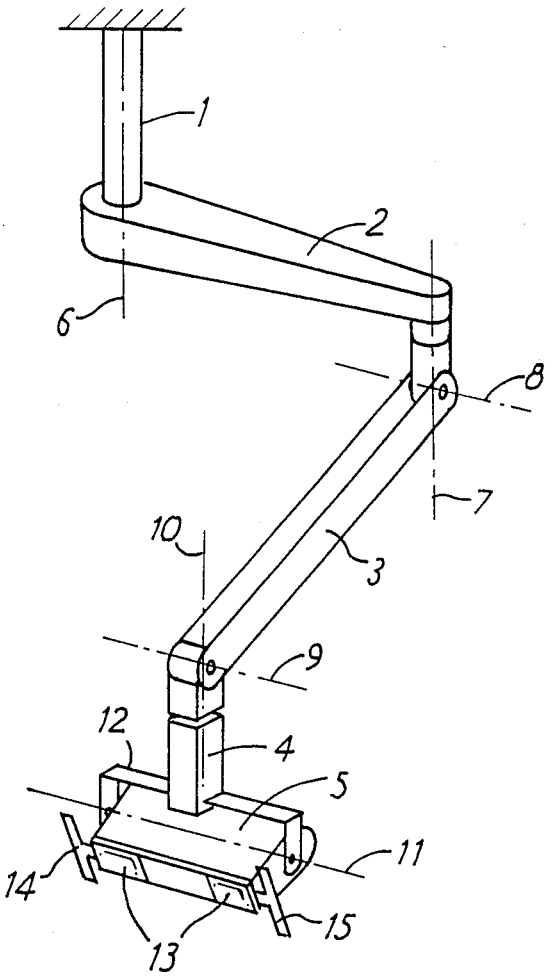
FIG. 1 PRIOR ART
FIG. 1 is a perspective view of a known lamp arrangement, described above.
Figure 2:
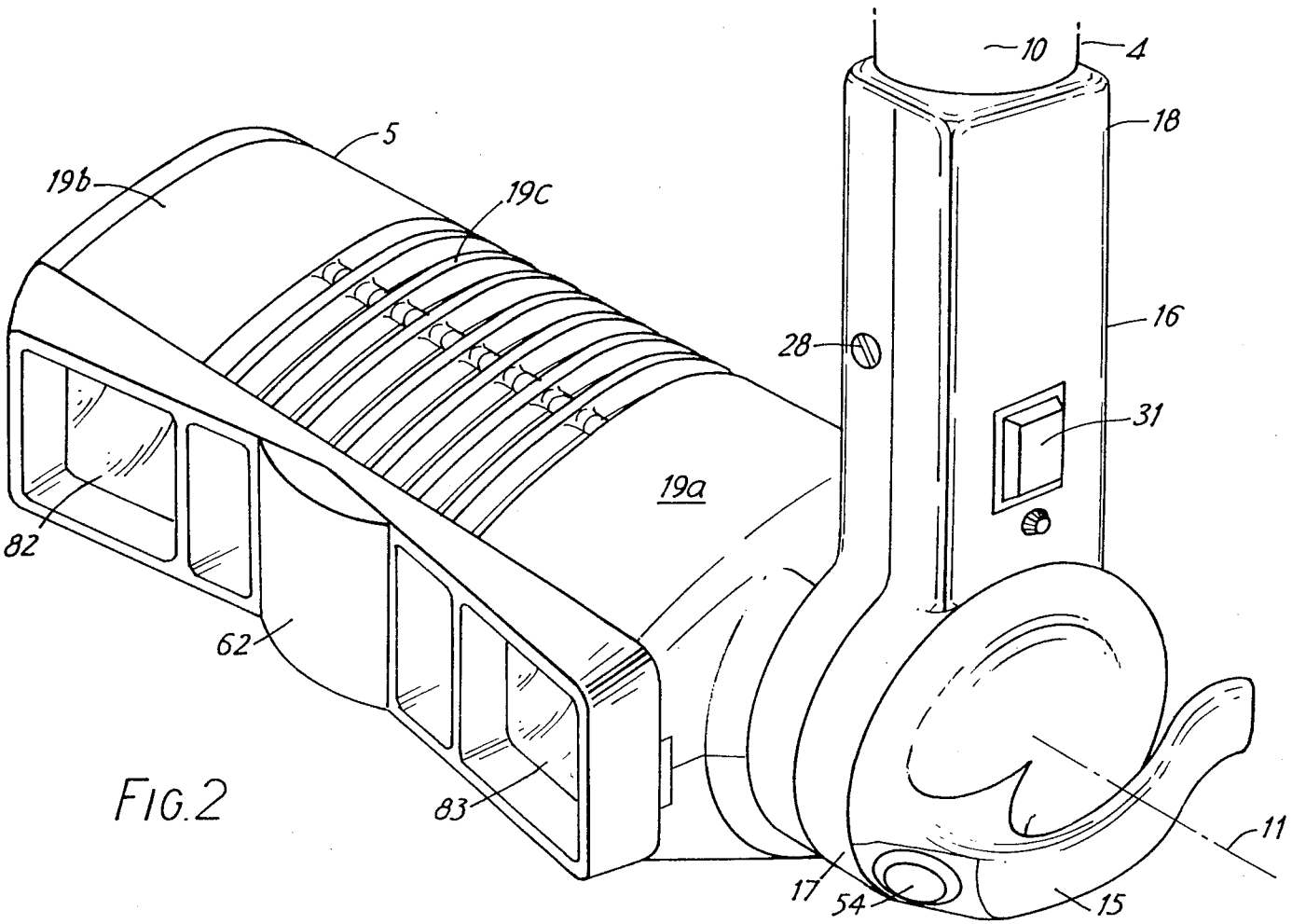
FIG. 2 is a general perspective view of one form of lamp according to the present invention.

FIG. 2 shows a general perspective view of a lamp body 5 disposed on one side of a bracket 16, whilst a handle 15 on the other side of the bracket 16 is secured to the lamp body 5 by a connection (described below) passing through a bearing in the lower part 17 of the bracket, so that, by means of the handle 15, the lamp body 5 can be rotated about a horizontal axis 11, for pitch adjustment of light beams from the lamp. The upper part 18 of the bracket forms a socket which engages the end 4 of a balanced support arm assembly; the end 4 including a bearing for rotation about vertical pivot axis 10. The support arm assembly could be as described above with reference to FIG. 1, or of any other suitable construction.

The lamp housing is formed from two end mouldings 19*a*, 19*b* flanking a set of ribs 19*c* which form a ventilation grille. The mouldings are secured together by bolts extending between the two end mouldings 19*a*, 19*b* and through the ribs 19*c*. A front panel 20 is fixed to the housing formed by the end moulding and the ribs.

Figure 3:
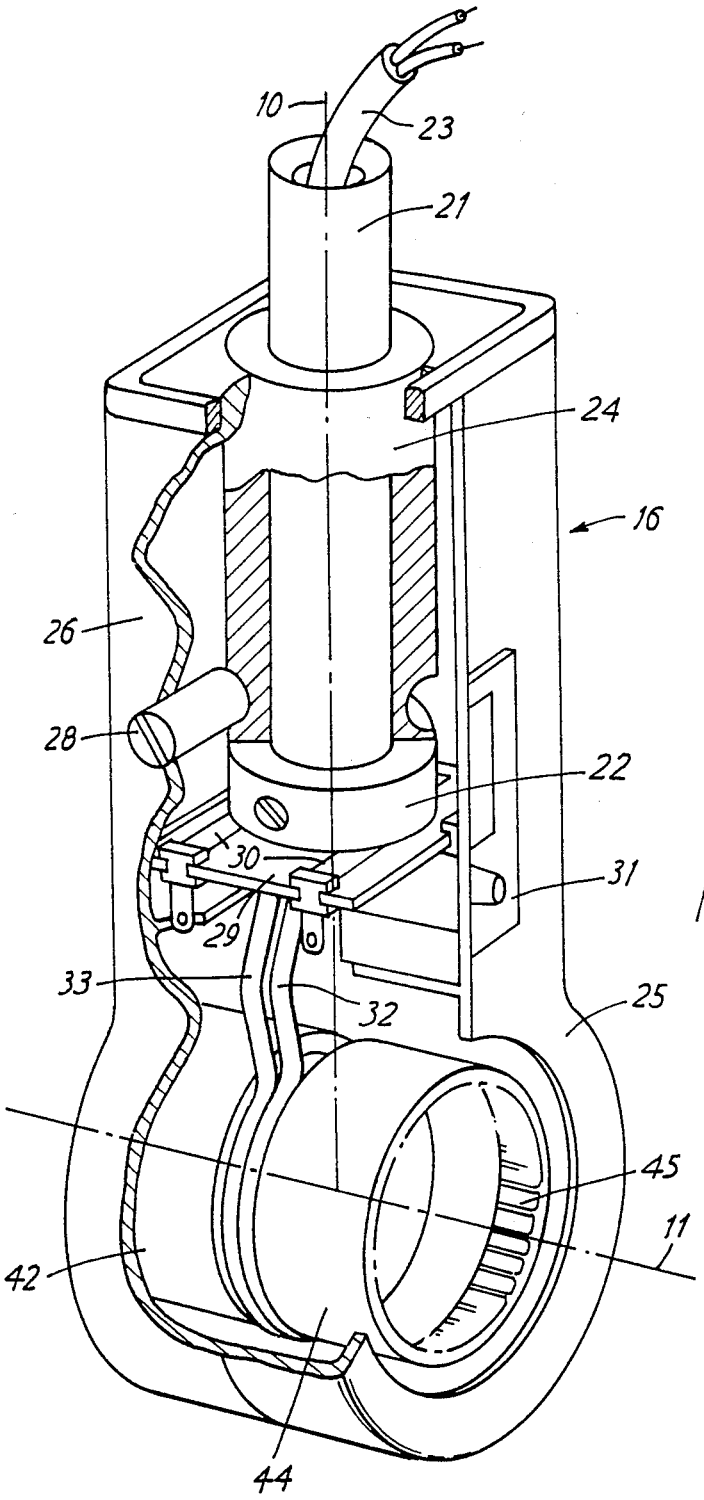
FIG. 3 is a cut-away perspective view of the slip-ring housing of the lamp of FIG. 2 shown with the mating parts of the balanced arm.

The construction of the embodiment will now be described in more detail with reference to FIGS. 3 to 7. Referring first to FIG. 3, certain parts of the end 4 of the balanced support arm are shown, for clarity of understanding. A tubular pivot 21 carries at its lower extremity a small two-track slip-ring 22 which is connected to an electrical supply by an electrical cable 23. The small slip-ring 22 retains a tapered swivel sleeve 24 that is free to rotate on the tubular pivot 21 and is constrained from excess axial movement by a part of the arm (not shown) that supports the tubular pivot 21.

The bracket 16 comprises a two piece moulded housing 25 and 26. The portions are shown cut away in FIG. 3. They have a joint line in the plane containing the axis 10 of the tubular pivot 21 and perpendicular to the axis 11 about which the lamp 5 rotates, these two axes being normal to each other.

The upper ends of the moulded housing portions 25 and 26 have ribs which, when the two are fixed together, form a conical socket into which the tapered swivel sleeve 24 fits and where it is retained by a dowel 28 that has suitable locking means (not shown).

Further ribs within the housing parts 25,26 retain a contact panel 29 that carries four leaf springs 30 each with a silver contact at its extremity and so arranged that two of these contacts press onto an inner silver plated track of the slip-ring 22 and the other two onto the outer such track. The slip-ring 22 may conveniently take the form of a printed-circuit disc. One conductor of the electrical cable 23 connects to the inner track and the other conductor to the outer track. Electrical current is collected by the contacts 30, one pole being passed via switch 31 to a cable 32 while the other pole is connected to a second cable 33.

The switch 31 may comprise a touch-sensitive on/off switch and a rotatable knob controlling the voltage supplied to the lamp, and therefore the brightness of the lamp.

The cables 32, 33 conduct current to and from the lamp housing. The cables are flexible and are loosely coiled around a spacer (described below). The cables pass to the lamp housing from the middle of the coil. Preferably, there are 3½ turns of cable in the coil. The rotation of the lamp housing about the axis 11 is limited to a range of 270° and is accommodated by the cable coil tightening and loosening about the spacer.

In an alternative embodiment, the rotation could be accommodated by using a second two-track slip ring transverse to the axis 11.

Figure 4:
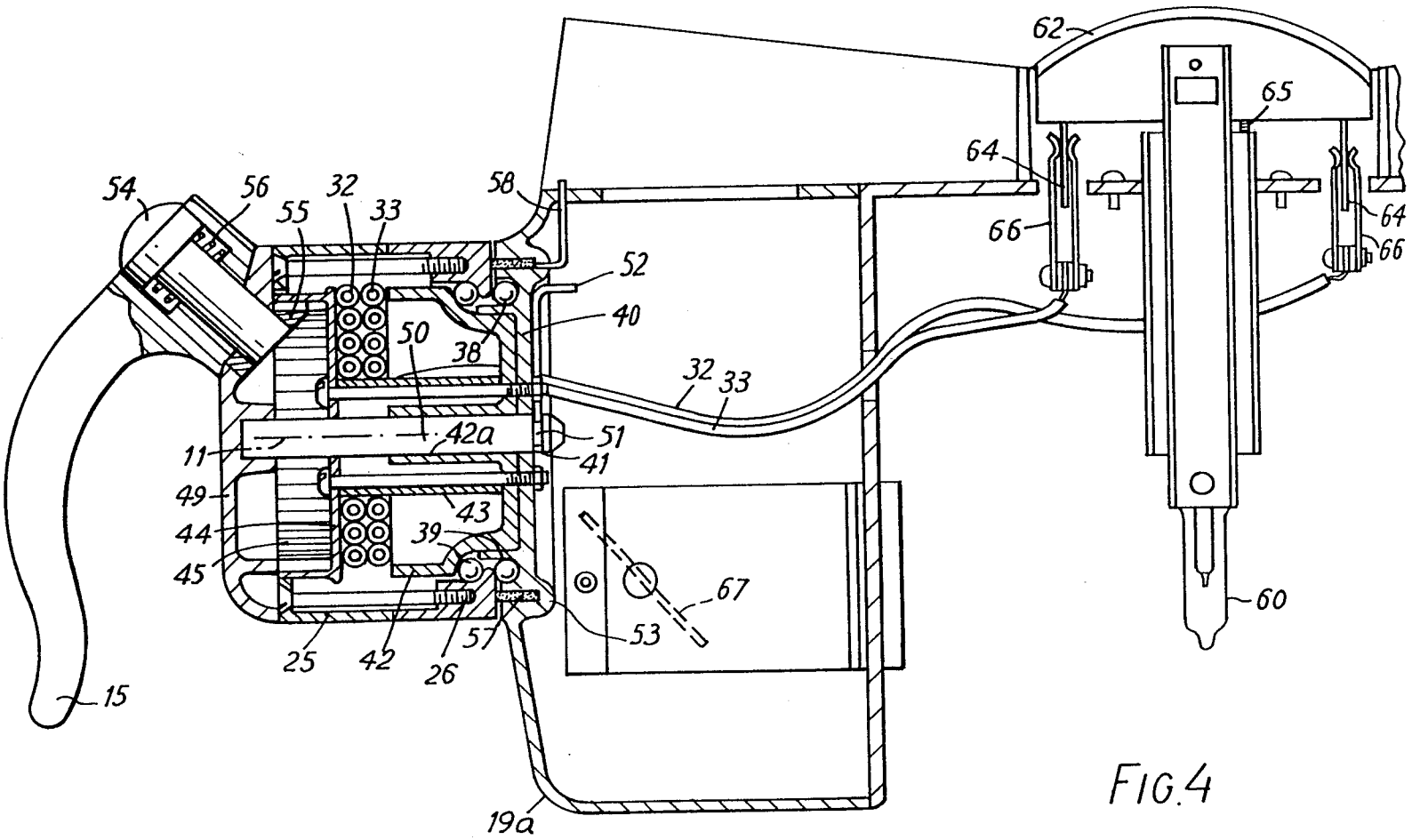
FIG. 4 is a section of part of the lamp of FIG. 2.

FIG. 4 is a horizontal section of the lamp housing at the axis 11, when the output light beams are horizontal.

The end moulding 19*a* of the lamp housing has a generally cylindrical extension 38. A cup member 42, a tubular spacer 43 and a second cup member 44 are bolted to an integral bulkhead 40 formed by the end wall of the moulding 19*a*. The second cup member 44 has an internal serrated clutch surface 45, shown more clearly in FIG. 3.

Bearing races 39 allow relative rotation of the cylindrical extension (and along with it the cup member 42) and the housing formed by the mouldings 25,26.

The flexible cables 32,33 which conduct current between the slip ring and the lamp housing are coiled around the spacer 43 and extend from the middle of the coil to the lamp housing.

The handle 15 is moulded with a domed disc 49 and carries an axial spigot 50 which is journelled in a tubular extension 42*a* of the cupped member 42. The spigot 50 extends through an aperture 41 in the moulding 19*a*. Adjacent the end of the spigot 50 is an annular groove 51 which is engaged by a notch in a lever 52 pivoted at 53, so that lever movement will retain or release the handle. A button headed recessed plunger 54 is incorporated into the handle and carries teeth 55 which can engage the serrated clutch surface 45 formed in the interior of the cup member 44. The teeth 55 are urged into engagement with the clutch surface 45 by a spring 56. Thus the handle 15 is normally locked to the moulding 19*a* but by pressing the plunger 54 the handle can be angularly reset to any desired relationship with the moulding for ease of control of the light position and orientation.

A felt dust seal 57 is provided against ingress of dust into the housing 25,26. A spring-biased lever 58 bears on the felt seal 57 to urge the seal against the housing portion 26, to provide frictional resistance against rotation of the lamp housing.

A lamp bulb 60 is carried on a plug-in mount 62. The bulb 60 may be introduced into the housing through an aperture 61 in the middle of the front panel 20. When the bulb 60 is in position, the mount 62 closes the aperture and is held in position in the aperture 61 by a latch (not shown). The mount 62 carries two flat prong electrodes 64 which are electrically connected to the bulb filament. When the mount 62 is in position, the electrodes 64 mate with respective spring contacts 66 to which respective ones of the cables 32,33 are connected. A grub screw 65 on the mount 62 sets the innermost position to which the mount 62 may be pushed.

Further details of the optical system of the lamp are described below.

Figure 5:
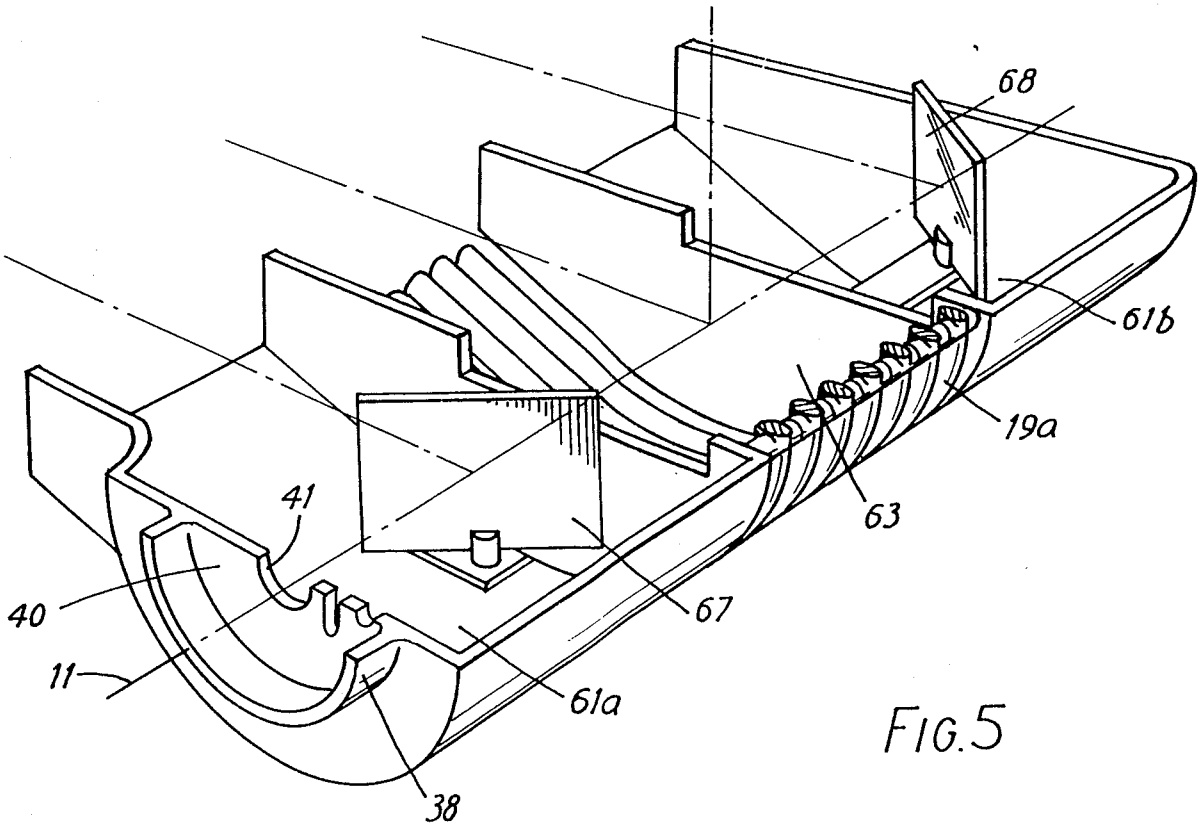
FIG. 5 is a perspective view of one half of the optical housing with some optical components in position.

The optical housing 37 is shown cut in half in FIG. 5, at the plane of the section of FIG. 4. The illustrated half of the housing has four main portions. Firstly, half of the cylindrical extension 38, terminating at the bulkhead 40, secondly a near mirror compartment 61*a*, thirdly a central light source compartment 63 and fourthly a far mirror compartment 61*b*.

The ribs 19*c* form a grille in the curved "floor" of the compartments 63 extending between the two bulkheads which separate the three compartments. The grille allows a cooling air flow around the light source in the compartment 63.

The two mirror compartments 61*a*,61*b* each have mountings to support mirrors 67,68 which re-direct the light beams leaving the compartments 62 so they converge at a point on a line which is normal to the axis 11 of rotation of the optical housing and which intersects this axis midway between the two mirrors. This intersection point is also midway between the light source compartment bulkheads.

The mirrors 67,68 may be coated so as to reflect visual light but allow infra-red heat to pass straight through. If this is so a black metal heat sink would be located a short distance behind each mirror to disperse the heat and prevent a hot spot on the housing.

In FIG. 5, the line along which the light beams leave the compartment 63 is coincident with the rotation axis 11. In FIG. 4, the line and the axis are shown spaced apart, but parallel. Either arrangement is practicable, but the arrangement of FIG. 4 has been found to facilitate balancing the lamp about the axis 11.

Figure 6:
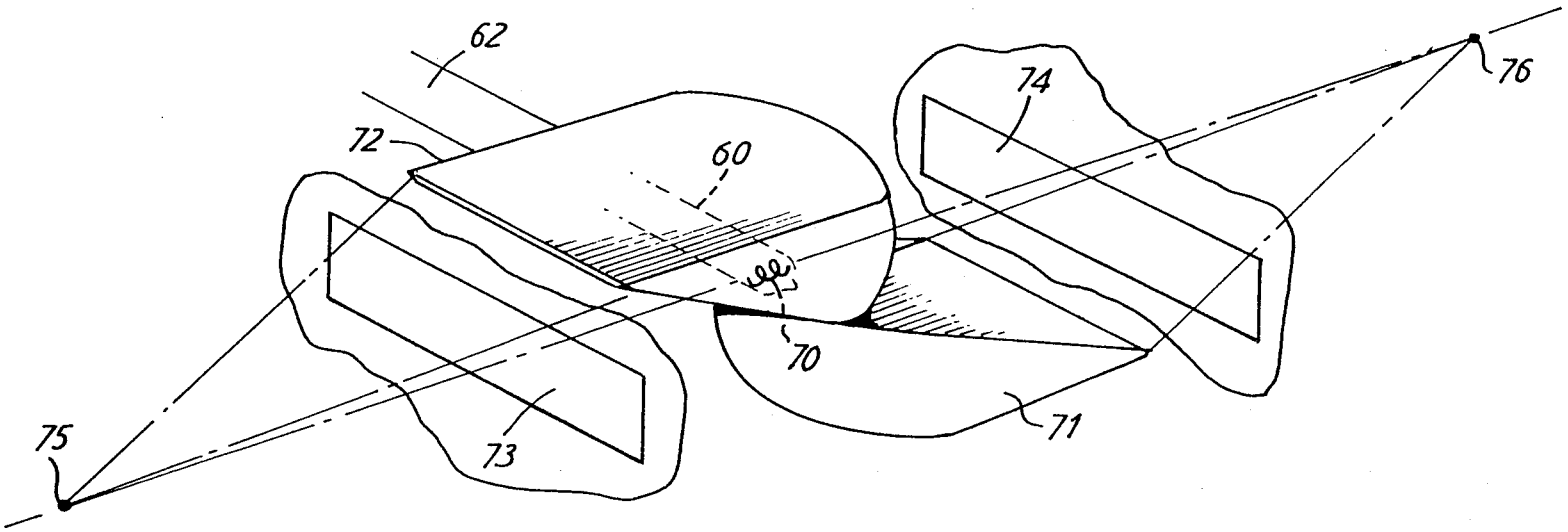
FIG. 6 is a perspective view of the main elements of the light source and reflector assembly.

The light source is shown in FIG. 6 and consists of a filament or discharge type bulb in a split reflector of the type which is the subject of our co-pending European patent application No. 83 307324.0

The bulb 60 (shown schematically) is arranged so that its filament 70 lies at the first focus point of the two curved reflector segments 71,72 so that equal light beams are emitted from approximately parallel edged apertures 73 and 74 to converge at second focus points 75 and 76.

As described above the bulb 60 is mounted on a mount 62 made of insulating material, the bulb filament being connected to a pair of prong electrodes 64. Wires inside the mount 62 feed current to the filament 70. The segments 71,72 are cut away as required to allow access for the bulb and the mount.

The mount 62 and the housing surfaces against which the mount locates are formed to ensure correct orientation of the filament and to form an abutment to ensure the filament is co-incident with the reflector focal point. For instance, non-circular integers and apertures may be used. The bulb 60 the reflector segments 71 and 72 and preferably the apertures 73 and 74 are carried in a heat conducting housing which can be finned on its exterior for adequate heat transfer by convected air flow through the housing grille.

This heat conducting housing is mounted on the housing bulkheads by two rectangular light tunnels aligned with the mirrors 67,68. These light tunnels may be closed at their extremities by glasses that diffuse the light and/or filter out heat from the beams.

Figure 7:
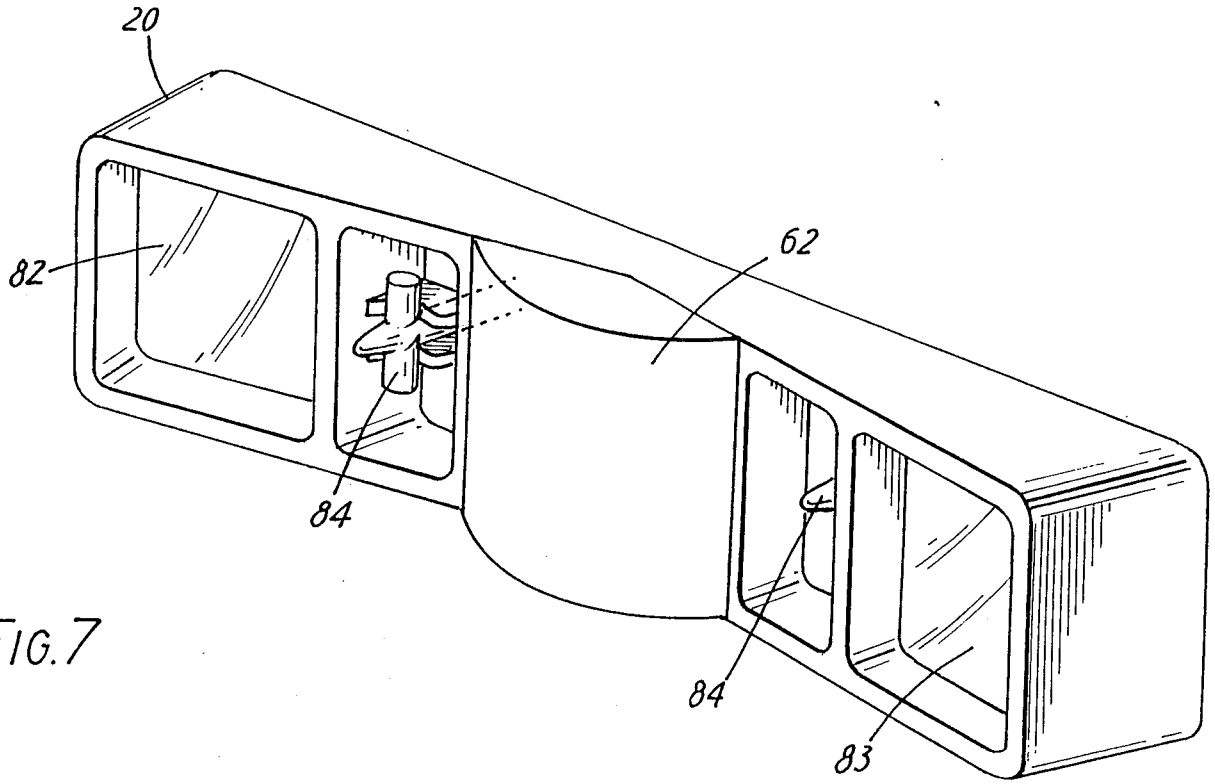
FIG. 7 shows the lens support member.

FIG. 7 shows a lens support member 20 which forms the front panel of the lamp housing. The two lenses 82,83 at the exit apertures of the housing are set at approx 7° toe-in angle to align with the axes of the converging beams. These lenses may either be of a spherical type or of a cylindrical type and may incorporate prisms. The requirements for the lenses and suitable lenses are described in the applicant's copending application referred to above.

The lens support member 20 is fixed on the housing by retaining screws and may be removed to permit cleaning of lenses 82 and 83, of mirrors 67 and 68 and blowing off of any dust around the finned lamp/reflector housing. Removal of the member 80 also permits operation of the lever 52 for removal of the handle 15.

The lenses 82,83 are adjustably fixed in mounts which are held in the member 20 by latches 84. The lens mounts may be removed to adjust the alignment of the lenses 82,83.

It will be appreciated that the handle 15 used to manoeuvre and orientate the lamp is very close to the vertical swivel axis of the swivel sleeve 24 and thus the greater forces required to move the articulated support arm can be applied almost directly to the arm and not by the usual awkward thumb and finger couple as is necessary when the swivel axis is located centrally on the lamp.

I claim:

1. An adjustable lamp comprising a lamp unit, a support, said lamp unit being mounted on said support, and said support providing a plurality of rotational degrees of freedom for said lamp unit about an equal plurality of axes, and a handle attached to said lamp unit asymmetrically, said unit being rotatable about one of the axes to alter the handedness of the lamp, and said lamp further comprising a clutch, said handle being connected to the lamp unit through said clutch, and said clutch, when released, allowing the handle to be rotationally adjusted relative to the lamp unit.

2. A lamp according to claim 1, wherein the lamp unit is free to rotate about a substantially vertical and a substantially horizontal axis.

3. A lamp according to claim 2, wherein the support permits translational motion of the lamp unit in a horizontal plane.

4. A lamp according to claim 2, wherein the support permits vertical translational motion of the lamp unit.

5. A lamp according to claim 2, wherein the lamp can be reversed for operation by left- or right-handed operators by rotating the lamp unit through 180° about each axis and rotationally adjusting the handle.

6. A lamp according to claim 2, wherein the handle is located on or near both axes.

7. A lamp according to claim 2, wherein said horizontal axis passes through the lamp unit.

8. A lamp according to claim 7, wherein the lamp unit comprises means operable to generate two mutually convergent light beams, said beams leaving the lamp unit in a plane containing said horizontal axis.

9. A lamp according to claim 2, wherein the handle and lamp unit are located on opposite sides of the support.

10. A lamp according to claim 2, further comprising a control member mounted on the handle and operable to release the clutch.

11. A lamp according to claim 10, wherein the clutch comprises a serrated clutch surface fixed to the lamp unit, and the control member has integral teeth and is mounted on the handle to be movable to bring the teeth into and out of engagement with the clutch surface.

12. A lamp according to claim 11, further comprising a cup member, said cup member being fixed to said lamp unit and having a portion of circular section, said clutch surface being formed on the inner face of said circular section, and the control member being movable in a direction having a component along a radius of the circular section.

13. A lamp according to claim 2, wherein the handle is shaped to conform to a surrounding, gripping hand.

* * * * *